US007038198B2

(12) United States Patent
Yamaguchi et al.

(10) Patent No.: US 7,038,198 B2
(45) Date of Patent: May 2, 2006

(54) MASS SPECTROMETER

(75) Inventors: Shinichi Yamaguchi, Uji (JP); Morio Ishihara, Toyonaka (JP); Michisato Toyoda, Ibaraki (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 10/957,642

(22) Filed: Oct. 5, 2004

(65) Prior Publication Data

US 2005/0077461 A1 Apr. 14, 2005

(30) Foreign Application Priority Data

Oct. 8, 2003 (JP) ..... 2003-349174

(51) Int. Cl.
*H01J 49/40* (2006.01)

(52) U.S. Cl. ..... 250/287; 250/282

(58) Field of Classification Search ..... 250/287, 250/282

See application file for complete search history.

(56) References Cited

U.S. PATENT DOCUMENTS 6,713,758 B1 * 3/2004 Guevremont et al. ..... 250/290
2004/0183007 A1 * 9/2004 Belov et al. ..... 250/287
2004/0232326 A1 * 11/2004 Guevremont et al. ..... 250/287

* cited by examiner

*Primary Examiner*—Nikita Wells
*Assistant Examiner*—Zia R. Hashmi
(74) *Attorney, Agent, or Firm*—Manabu Kanesaka

(57) ABSTRACT

A mass spectrometer includes a flight control device for allowing ions from an ion source to repeatedly fly along an orbit in a flight space for predetermined times; a detecting device for detecting the ions after the ions repeatedly fly along the orbit for the predetermined times; and a data processing device for starting collection of ion strength data detected by the detecting device. The ion strength data is obtained during the flight of the ions along the orbit, or when the ions are headed toward the detecting device after departing from the orbit, or when one of the above situations is estimated.

10 Claims, 3 Drawing Sheets

MASS SPECTROMETER

BACKGROUND OF THE INVENTION AND RELATED ART STATEMENT

The invention relates to a mass spectrometer, more specifically, a mass spectrometer having a flight space wherein ions to be analyzed make orbital movements or reciprocal movements on a substantially same orbit.

In a Time of Flight Mass Spectrometer (hereinafter referred to as "TOFMS"), generally, ions accelerated by an electric field are introduced into a flight space having no electric field nor magnetic field, and various ions are separated by a mass number according to a flight time until the ions reach a detector. A difference in the flight time between two different ions having different mass numbers increases as the flight time increases. Accordingly, a long flight distance is preferable in order to improve resolution in the mass number. However, it is generally difficult to provide a long flight distance linearly due to limitation in a size of a device. Conventionally, various structures have been proposed to effectively increase the flight distance.

For example, in a device disclosed in Japanese Patent Publication (Kokai) No. 11-297267, an oval orbit is formed using a plurality of troidal type sector-formed electric fields, and ions repeatedly fly around the oval orbit to increase the flight distance. In a device disclosed in Japanese Patent Publication (Kokai) No. 11-135061, a closed orbit is formed in an 8-character shape to increase the flight distance. In these TOFMSs, a flight time, from when an ion starts from an ion source to when the ion arrives at a detector after flying around the orbit for predetermined times, is measured. A mass number of the ion is determined according to the flight time. The flight time increases as the number (orbital flight number) of flying around the orbit increases. Accordingly, generally, resolution in the mass number is improved as the orbital flight number increases.

In the TOFMSs, generally, the detector starts collecting data of a detection signal (ion strength signal) when the ions start from the ion source to obtain a relationship between the flight time and the ion strength signal based on the data. However, in the TOFMSs having the structures described above, when the flight number of the ions increases, the flight time becomes longer in proportion thereto. Accordingly, it is necessary to collect a large amount of the data, thereby requiring a large capacity for storing the data.

In view of the problems described above, the present invention has been made, and an object of the present invention is to provide a mass spectrometer having an orbit in a flight space so that ions repeatedly fly along the orbit several times, wherein a capacity for storing collected data is reduced.

Further objects and advantages of the invention will be apparent from the following description of the invention.

SUMMARY OF THE INVENTION

In order to attain the objects described above, according to the present invention, a mass spectrometer includes:

a) a flight control device for allowing ions started from an ion source to repeatedly fly along a predetermined orbit in a flight space for predetermined times;

b) a detecting device for detecting the ions after the ions repeatedly fly along the orbit for the predetermined times; and c) a data processing device starting collecting ion strength data detected by the detecting device during the ions flying along the orbit; when the ions leave the orbit and move toward the detecting device; or when it is assumed to be one of the above-mentioned time points.

Here, the predetermined orbit is arranged in the flight space to obtain a long flight distance in the narrow flight space, and may have any shape as far as the ions repeatedly fly along substantially the same orbit. For example, the predetermined orbit may be formed in a fly-around orbit such as a circular shape, oval shape, and 8-character shape; a turning orbit such as a spiral shape; or a reciprocal path such as a straight line or curved line.

Incidentally, the ion source is not limited to a device for generating the ions from a molecule or an atom, and may be any device as far as the device includes means for providing kinetic energy to the ions so that the ions are introduced into the flight space.

In the mass spectrometer according to the present invention, with the control of the flight-control device, the ions started from the ion source are guided to be placed on the orbit. After the ions fly along the orbit several times, the ions leave the orbit and head toward the detector. The detector outputs the ion strength signal corresponding to the number of the ions arrived thereat. In a conventional mass spectrometer, the detector starts collecting the ion strength data when the ions start from the ion source. However, in the mass spectrometer according to the present invention, the data processing device starts collecting the ion strength data during the ions flying along the orbit or when the ions leave the orbit and head toward the detector. In order to calculate an entire flight time of the ions, a time from when the ions start form the ion source to when collection of the ion strength data starts is separately measured, and the measured time and the collected data are processed together.

When a type of ion to be analyzed is known or can be estimated with high accuracy, it is possible to estimate a time when the ions from the ion source arrive in the vicinity of a predetermined position on the orbit, or a time when the ions from the ion source reach a position where the ions leave from the orbit. Therefore, it is possible to start collection of the ion strength data at a time point during the ions flying along the orbit, or at a time point when the ions leave the orbit and head toward the detector.

A non-destructive type detector may be provided at a predetermined position along the flight orbit of the ions for detecting passage of the ions, and collection of the ion strength data starts according to an output of the detector. Accordingly, instead of the estimation described above, the collection of the ion strength data starts at a time point when the ions actually arrive at a predetermined position.

According to the mass spectrometer of the invention, it is not necessary to collect the data during a large portion of the period when the detecting signal has no change until the ions arrive at the detector. Accordingly, as compared with a case where the data are collected from the time point when the ions are launched, it is possible to greatly reduce a memory area for storing the collected data, thereby reducing cost of the data processing device. With the reduced data quantity, it is also possible to reduce a load of processing data. Of course, even if the data quantity is reduced as described above, the accuracy and sensitivity of the analysis are not impaired.

DETAILED DESCRIPTION OF PREFERRED EMBODIMENTS

Figure 1:
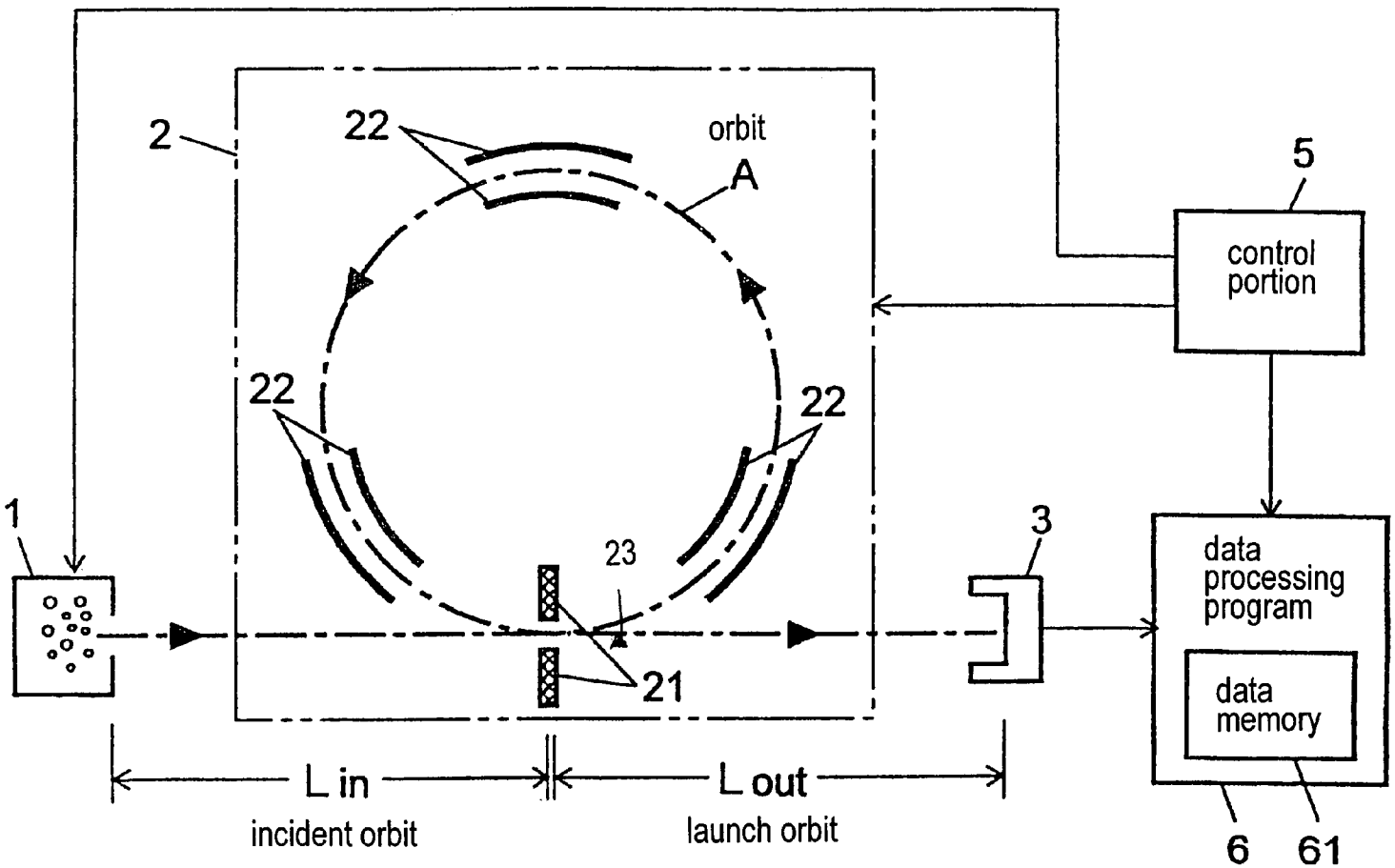
FIG. 1 is a block diagram showing an essential part of a mass spectrometer according to an embodiment of the invention.

Hereunder, embodiments of the present invention will be explained with reference to the accompanying drawings. FIG. 1 is a block diagram showing a mass spectrometer according to an embodiment of the present invention. In FIG. 1, an ion source 1, a flight space 2, and an ion detector 3 are disposed in a vacuum chamber (not shown).

The ion source 1 ionizes molecules to be analyzed, and an ionizing method is not limited to a specific one. For example, when the mass spectrometer of the invention is used for GC/MS, the ion source 1 may ionize gas molecules with electron ionization method or chemical ionization method. When the mass spectrometer is used for LC/MS, the ion source 1 may ionize liquid molecules with atmospheric pressure chemical ionization method or electrospray ionization method. When molecules to be analyzed are macromolecules such as a protein, matrix assisted laser desorption ionization (MALDI) method may be used.

The flight space 2 includes therein guide electrodes 22 for allowing the ions to fly along a substantially circular orbit A, and gate electrodes 21 for allowing the ions introduced into the flight space 2 to be placed on the orbit A or allowing the ions flying on the orbit A to leave therefrom. Incidentally, in the present embodiment, the orbit A is formed in a circular shape, and is not limited thereto. In addition to an oval or an 8-character shape, the orbit A may have other shapes. Further, the orbit need not be the completely same shape, and may be a swiveling orbit having a gradually shifted position such as a spiral shape and a reciprocating orbit.

The ion detector 3 includes, for example, a photoelectron multiplier for outputting a signal (ion strength signal) corresponding to the number or quantity of the incident ions to a data processing portion 6. The data processing portion 6 is embodied by carrying out a predetermined processing program on, for example, a personal computer. Based on the ion strength signal, a mass spectrum with an abscissa axis representing the mass number and a vertical axis representing the ion intensity is obtained, and a qualitative analysis or a quantitative analysis is carried out based on the mass spectrum. The control portion 5 properly controls the ion source 1 and the electrodes 21 and 22 in the flight space 2 for performing the mass spectrometry.

Figure 2:
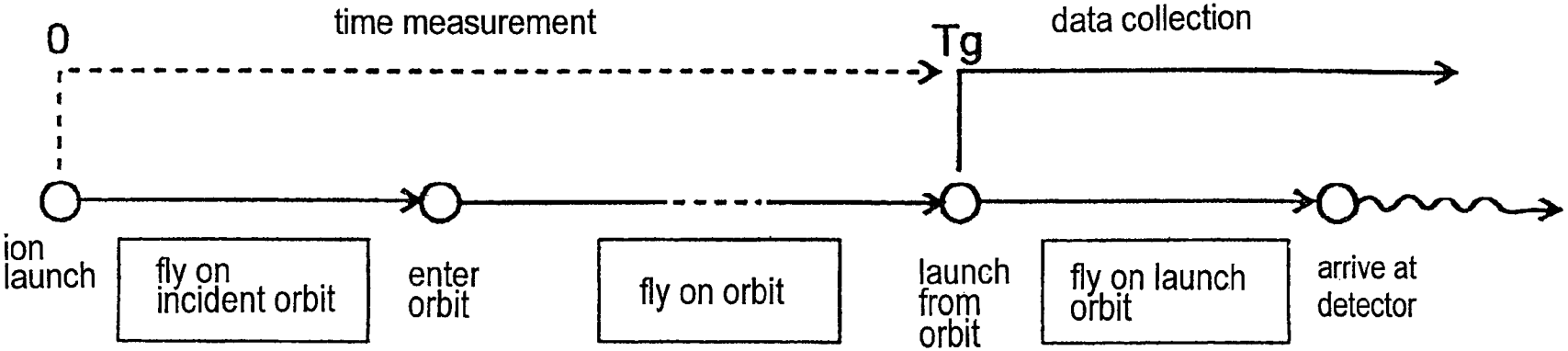
FIG. 2 is a schematic view showing a flight condition of ions and a process content associated therewith.

Next, a characteristic operation of the mass spectrometer will be explained with reference to FIG. 2. The ion source 1 provides kinetic energy to the ions to be analyzed under the control of the control portion 5. Thus, the ions are launched from the ion source 1 to start flying (ion launch). When the data processing portion 6 receives an ion launch signal from the control portion 5, the data processing portion 6 starts measuring a time. The ions from the ion source 1 enter the flight space 2 and reach the gate electrodes 21. A distance of a flight path (incident orbit) from the ion source 1 to the gate electrodes 21 is represented as Lin. The gate electrodes 21 place the ions on the orbit A (enter orbit), and the guide electrodes 22 allow the ions to fly on the orbit A. The orbital flight number is controlled by the control portion 5. During the flight of the ions on the orbit A, the time measurement is continued.

It is possible to estimate the mass number of the ions to be analyzed with high accuracy, and also possible to calculate a flight speed based on the estimation. Therefore, a timing for changing a voltage applied to the gate electrodes 21 is estimated beforehand as an elapsed time from the ion launch time, so that the ions leave the orbit A after the desired orbital flight number. Specifically, in a case that the desired number of the orbital flights is n, it is necessary to change the voltage applied to the gate electrodes 21 after (n−1) orbital flights. Also, even if the ions have the same mass number, it is necessary to take into consideration a displacement in the starting position and time-based jitter due to a difference in kinetic energy. In view of the above considerations, the timing Tg for changing the voltage applied to the gate electrodes 21 is calculated beforehand, and the control portion 5 is set to change the voltage applied to the gate electrodes 21 at the timing Tg.

Figure 3:
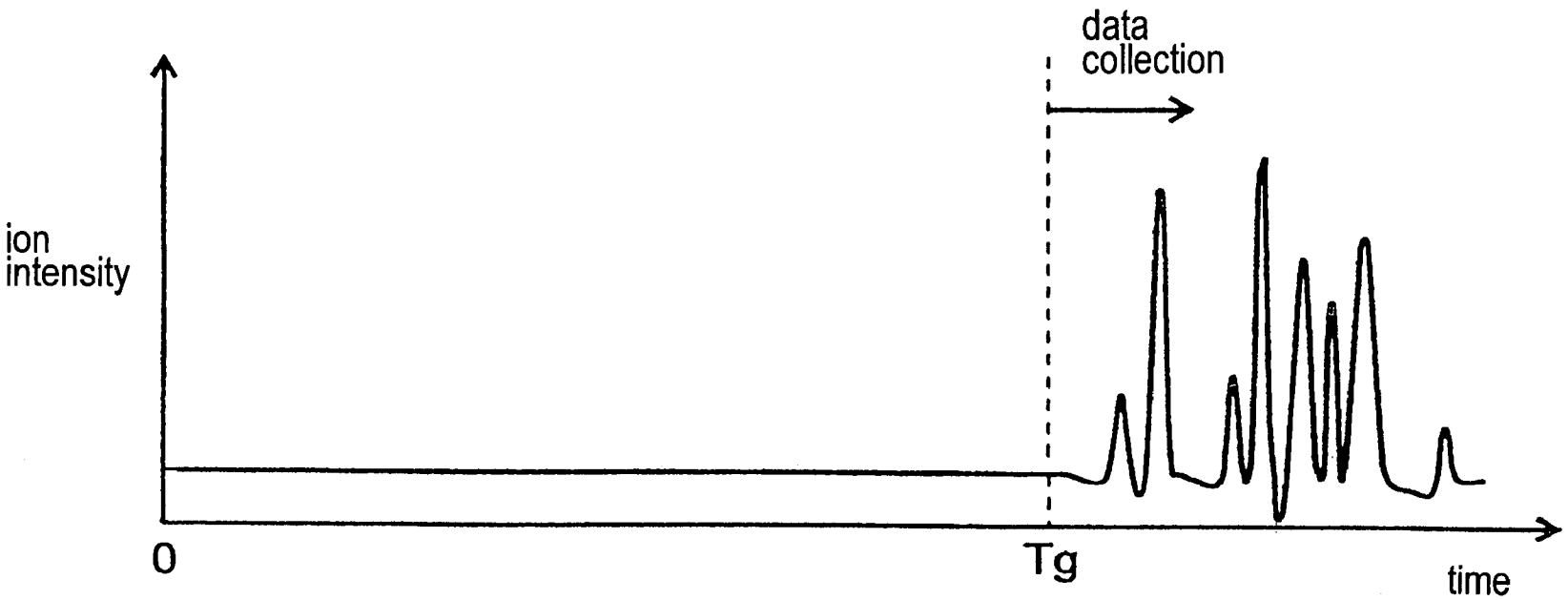
FIG. 3 is a graph showing an example of a fluctuating state of a detected signal obtained from the mass spectrometer according to the embodiment of the invention.

Through the control of the controlling portion 5, after the ions to be analyzed circle for the desired orbital flight number, the ions depart from the orbit A when the ions pass through the gate electrodes 21 to proceed to the ion detector 3. When the voltage applied to the gate electrodes 21 is changed, the data processing portion 6 starts storing the detected data obtained by digitizing the detected signal from the ion detector 3 in a data memory 61. In other words, collection of the detected data starts at the timing Tg. The ions actually arrive at the ion detector 3 after the ions passing through the gate electrodes 21 fly along a launch orbit, i.e. a distance Lout. Therefore, the detected signal at the ion detector 3 starts changing shortly after the voltage applied to the gate electrodes 21 is changed (refer to FIG. 3).

A proportion of the launch orbit after the ions depart from the orbit A is small relative to the whole orbit starting from the ion source 1 to the ion detector 3. Also, the proportion decreases as the orbital flight number increases. That is, since the data collection starts from the timing Tg as described above, it is possible to reduce the data quantity to be collected as compared with a case where the data collection starts from the ion launch time point.

Incidentally, in the embodiment, the start timing of the detected data collection is estimated based on the flight position of the ions. Instead of the estimation, passage of the ions may be actually detected to set the start timing of the detected data collection. Specifically, a detector 23 called a non-destructive ion type detector may be disposed adjacent to the gate electrodes 21 for outputting an electric signal corresponding to a quantity of the passing ions, i.e. charged particles, through electromagnetic induction. When the detector 23 detects the passage of the ions departed from the orbit A, the detected data collection is started. Thus, even if the mass number of the ions to be analyzed is not known, it is possible to start the data collection at a suitable time during the ion flight.

Incidentally, the above-explained embodiment is just an example according to the present invention, and any modification may be possible within a scope of the subject matter of the invention.

The disclosure of Japanese Patent Application No. 2003-349174, filed on Oct. 8, 2003, is incorporated in the application.

While the invention has been explained with reference to the specific embodiments of the invention, the explanation is illustrative and the invention is limited only by the appended claims.

What is claimed is:

1. A mass spectrometer comprising:

flight control means for allowing ions from an ion source to repeatedly fly along an orbit in a flight space for predetermined times;

detecting means for detecting the ions after the ions repeatedly fly along the orbit for the predetermined times; and data processing means electrically connected to the detecting means, said data processing means starting collection of ion strength data detected by the detecting means at a first time point during the flight of the ions along the orbit, or a second time point when the ions are headed toward the detecting means after departing from the orbit.

2. A mass spectrometer according to claim 1, wherein said data processing means starts collection of the ion strength data when the first time point or the second time point is estimated.

3. A mass spectrometer according to claim 1, wherein said flight control means includes a guide electrode for allowing the ions to fly along the orbit, and a gate electrode disposed on the orbit for changing a course of the ions to enter or depart from the orbit according to a voltage applied to the gate electrode.

4. A mass spectrometer according to claim 3, wherein said data processing means includes a control unit electrically connected to the guide and gate electrodes and the detecting means for controlling the electrodes and processing data such that the detecting means starts detecting the data when the ions move along the orbit or after the control unit applies the voltage to the gate electrode to move the ions out of the orbit.

5. A mass spectrometer according to claim 4, wherein said control unit starts processing the data according to a mass number of the ions.

6. A mass spectrometer according to claim 4, further comprising a non-destructive detector disposed along the orbit for detecting the ions moving on the orbit so that the control unit applies the voltage to the gate electrode to move the ions out of the orbit after the ions move along the orbit for predetermined times.

7. A mass spectrometer according to claim 1, wherein the orbit is a regular shape during each revolution.

8. A mass spectrometer according to claim 7, wherein the orbit shape is selected from the group consisting of circular and oval.

9. A mass spectrometer according to claim 1, wherein the orbit is a swiveling shape having a gradually shifted position.

10. A mass spectrometer according to claim 9, wherein the orbit shape is spiral.

* * * * *